US008900377B2

(12) United States Patent
Graham

(10) Patent No.: US 8,900,377 B2
(45) Date of Patent: Dec. 2, 2014

(54) FLEXIBLE PIPE HAVING INCREASED ACID RESISTANCE AND/OR CORROSION RESISTANCE

(75) Inventor: Geoffrey Stephen Graham, Newcastle-upon-Tyne (GB)

(73) Assignee: GE Oil & Gas UK Limited, Bristol (GB)

( * ) Notice: Subject to any disclaimer, the term of this patent is extended or adjusted under 35 U.S.C. 154(b) by 315 days.

(21) Appl. No.: 13/125,284

(22) PCT Filed: Aug. 14, 2009

(86) PCT No.: PCT/GB2009/051024

§ 371 (c)(1), (2), (4) Date: Apr. 20, 2011

(87) PCT Pub. No.: WO2010/046672

PCT Pub. Date: Apr. 29, 2010

(65) Prior Publication Data

US 2011/0195208 A1 Aug. 11, 2011

(30) Foreign Application Priority Data

Oct. 21, 2008 (GB) ..... 0819298.1

(51) Int. Cl.

| | |
|---|---|
| ***C23C 8/06*** | (2006.01) |
| ***C23C 8/68*** | (2006.01) |
| ***C23C 8/42*** | (2006.01) |

(52) U.S. Cl.
CPC .... *C23C 8/68* (2013.01); *C23C 8/42* (2013.01)
USPC ..... 148/279; 148/217

(58) Field of Classification Search
USPC ..... 148/279, 217
See application file for complete search history.

(56) References Cited

U.S. PATENT DOCUMENTS

2002/0036030 A1 3/2002 Baudis et al.

FOREIGN PATENT DOCUMENTS

| | | | |
|---|---|---|---|
| EP | 1026282 | A | 8/2000 |
| WO | WO2007/125276 | A | 11/2007 |
| WO | WO2008/100155 | A | 8/2008 |

OTHER PUBLICATIONS

International Preliminary Report on Patentability of the International Searching Authority, mailed May 5, 2011, for corresponding International Application No. PCT/GB2009/051024, 8 pages.
International Search Report and Written Opinion of the International Searching Authority, mailed Oct. 28, 2009, for corresponding International Application No. PCT/GB2009/051024, 17 pages.
Akram et al., "Synthesis, characterization and corrosion protective properties of boron-modified polyurethane from natural polyol," *Progress in Organic Coatings*, vol. 63, Issue 1, pp. 25-32, Jul. 2008.

*Primary Examiner* — Michael C Miggins
(74) *Attorney, Agent, or Firm* — Klarquist Sparkman, LLP

(57) ABSTRACT

Use of a boron holding grease or fluid or oil for the purpose of increasing acid resistance and/or corrosion resistance in at least one metallic component of a flexible pipe body.

12 Claims, 4 Drawing Sheets

FLEXIBLE PIPE HAVING INCREASED ACID RESISTANCE AND/OR CORROSION RESISTANCE

CROSS REFERENCE TO RELATED APPLICATIONS

This is the U.S. National Stage of International Application No. PCT/GB2009/051024, filed Aug. 14, 2009, which in turn claims the benefit of United Kingdom Application No. GB0819298.1, filed Oct. 21, 2008.

The present invention relates to flexible pipes which may be used to convey fluids, such as production fluids, and to a boron holding grease used for treating parts or the whole of such flexible pipes. In particular, but not exclusively, the present invention relates to flexible pipe body including one or more metallic components and the use of a boron holding grease, fluid or oil to treat those metallic components for the purpose of increasing acid resistance and/or corrosion resistance.

Traditionally, flexible pipe is utilised to transport production fluids, such as oil and/or gas and/or water, from one location to another. Flexible pipe is particularly useful in connecting a sub-sea location to a further sub-sea location or a sea level location. Flexible pipe is generally formed as an assembly of a length of flexible pipe body and one or more end fittings. The pipe body is typically formed as a composite of tubular layers of material that form a fluid and pressure containing conduit. The pipe structure allows large deflections without causing bending stresses that impair the pipe's functionality over a desired lifetime. The pipe body is generally, but not necessarily, built up as a composite structure including metallic and polymer layers. Flexible pipe may be utilised as a flowline over land and/or at a sub-sea location. Flexible pipe may also be used as a jumper or riser.

In many prior known flexible pipes of this type a "pressure armour layer" is utilised to help reinforce an internal pressure sheath such as a fluid barrier or liner and prevent radial expansion and burst through due to differential pressure conditions acting across the pipe. The pressure armour layer is typically formed by a helically wound metal tape having an interlocking cross section.

In many prior known flexible pipes of this type a "tensile armour layer" is utilised to help reinforce the flexible pipe. The tensile armour layer or layers are typically formed by helically wound wires or tapes, often at opposed lay angles, wrapped around underlying layers.

In many prior known flexible pipes of this type an inner carcass is utilised to help reinforce a barrier layer to prevent collapse of the barrier layer when the flexible pipe is subjected to external pressures greater than an internal pressure. The carcass is typically formed by winding a metallic tape in a helical manner.

Transportation of production fluids, such as oil and gas, is known to often lead to various layers of the flexible pipe being subject to relatively acidic conditions. Such "sour" service is usually due to the migration of hydrogen sulphide (H2S) from the internal bore of the pipe radially outwards. This can be caused because some production fluids are relatively high in concentrations of hydrogen sulphide gas held in solution. Under such circumstances over time hydrogen sulphide can permeate through the barrier layer or liner into annulus regions defined between layers of the flexible pipe body. The H2S collects in these regions and gradually increases the acidity of the environment in those annular regions. Metal components, for example the tapes forming the pressure armour layer and/or tensile armour layer in those regions, are thus subjected to acid enhanced corrosion.

Over time continual migration of hydrogen sulphide can result in a build up of hydrogen sulphide gas which is particularly aggressive. H2S is known to attack ferrous steels, as well as other metals, and accelerate corrosion.

It will be appreciated that an inner metal carcass layer is continually subjected to such acid related corrosion although the flow of fluid in the bore often mitigates this effect to some extent.

It will also be appreciated that end fittings potentially including many metallic component parts are often utilised to terminate ends of the flexible pipe body. Like a carcass parts of the end fittings are continually subjected to an acidic environment. Other parts of the end fittings are subjected to such acid environments when hydrogen sulphide migrates through a barrier layer or liner over time and collects as noted above.

Operating under acidic conditions, so-called a sour service, can seriously affect overall performance of a flexible pipe over time. This can lead to a reduced lifetime expectation, or in the worst cases result in failure of the flexible pipeline during use. In the past various venting techniques have therefore been suggested to vent off accumulated H2S from various regions of the flexible pipe body. This has required inclusion of various valves with fluid passages connecting the valves to the annular regions where gas is expected to be accumulated. It will be appreciated that such valves and passageways can become blocked or fail over time. Also it is costly to include such features.

As an alternative specific sour service materials have been utilised for potentially vulnerable components of the flexible pipe body. Such sour service material has typically been a specially formulated batch of steel including corrosion resistant additives. It will be appreciated that such sour service materials are more expensive to utilise and are often weaker in performance terms than their non sour service material options. There has thus been, in the prior art, a trade off between the need for bigger wires versus corrosion resistance.

It is an aim of the present invention to at least partly mitigate the above-mentioned problems.

It is an aim of certain embodiments of the present invention to provide flexible pipe body including one or more pressure armour layers and/or tensile armour layers which have an increased acid resistance and/or corrosion resistance.

It is an aim of certain embodiments of the present invention to provide a method for manufacturing a flexible pipe including a length of flexible pipe body and one or more end fittings in which some or all of the metallic components in the flexible pipe body and/or end fittings are treated to have an increased resistance to acid attack.

According to a first aspect of the present invention there is provided use of a boron holding grease or fluid or oil for the purpose of increasing acid resistance and/or corrosion resistance in at least one metallic component of a flexible pipe body.

According to a second aspect of the present invention there is provided a method for treating a pressure armour and/or tensile armour layer of a flexible pipe body, comprising the steps of:

applying a boron holding grease or fluid or oil to at least a portion of the pressure armour layer and/or tensile armour layer of a flexible pipe body to improve acid resistance of the layer.

According to a third aspect of the present invention there is provided a method for treating a carcass of a flexible pipe body, comprising the steps of:

applying a boron holding grease to at least a portion of the carcass to improve corrosion resistance of the carcass layer.

According to a fourth aspect of the present invention there is provided a method for treating at least one metallic component of a flexible pipe body, comprising the steps of:

applying a boron holding grease or fluid or oil to at least a portion of the metallic component during manufacture of the flexible pipe body to thereby improve acid resistance and/or corrosion resistance of the metallic component when in service.

According to a fifth aspect of the present invention there is provided a boron holding grease or fluid or oil for use in the process of increasing acid resistance and/or corrosion resistance in at least one metallic component of a flexible pipe body.

Certain embodiments of the present invention provide a boron holding grease or fluid or oil for use in the process of increasing acid resistance and/or corrosion resistance in at least one metallic component of a flexible pipe body. This makes use of a hitherto unnoticed protective effect produced by use of such grease on any treated metallic components of flexible pipe body.

For many years Boron based grease products have been used in certain selected places to improve friction and wear properties between metallic layers such as pressure armour layers and/or tensile armour layers in flexible pipe body. Effectively the grease has just been used as a lubricant. Embodiments of the present invention make use of a previously unnoticed protective effect caused by using such grease to improve the sour service capability of metals. According to certain embodiments of the present invention boron based grease or other boron carrying fluid or oil can be applied to the metallic parts of one or more layers of a flexible pipe or other metal components which are required to have resistance to acid corrosion or require improved sour service capability. It has now been appreciated that after a period of exposure a chemical reaction modifies the surface of the material to produce a corrosion regulating coating or film. The coating is self-healing when in the presence of boron and air/moisture so any surface damage will also be quickly modified to produce a surface coating with increased resistance to acid. It is thus more advantageous to use a boron holding grease than was previously understood. Also to use such a grease in areas of the flexible pipe where it has not been used intentionally to date.

Embodiments of the present invention will now be described hereinafter, by way of example only, with reference to the accompanying drawings in which.

In the drawings like reference numerals refer to like parts.

Figure 1:
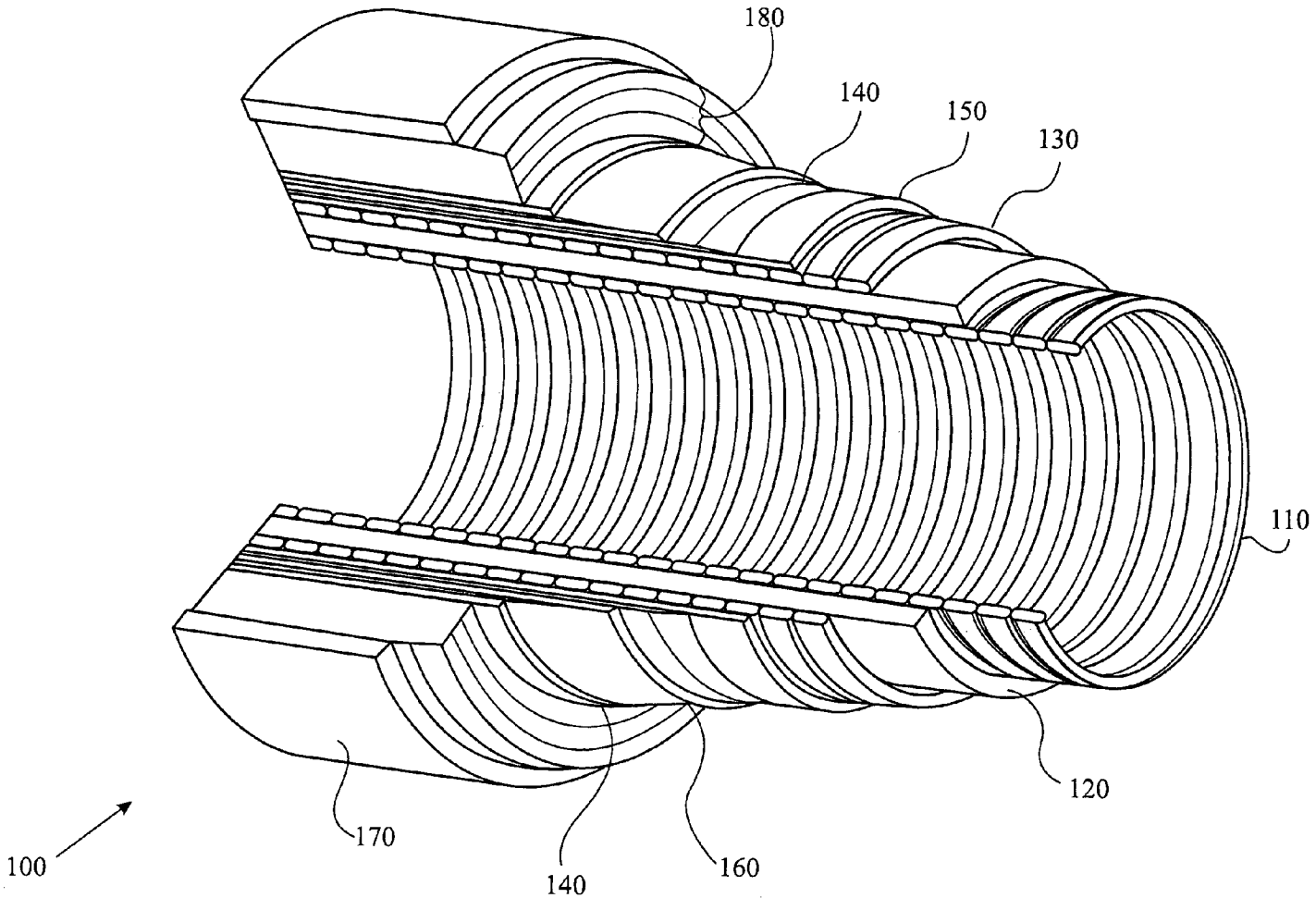
FIG. 1 illustrates a flexible pipe body.

Throughout this specification reference will be made to a flexible pipe. It will be understood that a flexible pipe is an assembly of a portion of pipe body and one or more end fittings in each of which an end of the pipe body is terminated. FIG. 1 illustrates how a pipe body 100 is formed in accordance with an embodiment of the present invention from a composite of layered materials that form a pressure-containing conduit. Although a number of particular layers are illustrated in FIG. 1, it is to be understood that the present invention is broadly applicable to composite pipe body structures including two or more layers. It is to be further noted that the layer thicknesses are shown for illustrative purposes only.

As illustrated in FIG. 1, pipe body includes an innermost carcass layer 110 and a pressure sheath 120. The carcass 110 provides an interlocked metallic construction that can be used as the innermost layer to prevent, totally or partially, collapse of an internal pressure sheath 120 due to pipe decompression, external pressure, tensile armour pressure and mechanical crushing loads. It will be appreciated that embodiments of the present invention are applicable to "smooth bore" as well as such "rough bore" applications.

The internal pressure sheath 120 acts as a fluid retaining layer and typically comprises a polymer layer that ensures internal-fluid integrity. It is to be understood that this layer 120 may itself comprise a number of sub-layers. It will be appreciated that when the optional carcass 110 layer is utilised the internal pressure sheath 120 is often referred to as a barrier layer. In operation without such a carcass 110 (so-called smooth-bore operation) the internal pressure sheath 120 may be referred to as a liner.

A pressure armour layer 130 is formed over the internal pressure sheath 120 and is a structural layer with a lay angle close to 90° that increases the resistance of the flexible pipe body 100 to internal and external pressure and mechanical crushing loads. The armour layer 130 also structurally supports the internal-pressure sheath 120 and typically consists of an interlocked metallic construction.

The flexible pipe body 100 may also include one or more layers of tape 140 and a first tensile armour layer 150 and a second tensile armour layer 160. Each tensile armour layer 150, 160 is a structural layer with a lay angle typically between 20° and 55°. Each layer 150, 160 is used to sustain tensile loads and internal pressure. The tensile armour layers 150, 160 are counter-wound in pairs.

The flexible pipe comprises at least one portion, sometimes referred to as a segment or section of pipe body 100 together with an end fitting located at at least one end of the flexible pipe body. An end fitting provides a mechanical device which forms the transition between the flexible pipe body and a connector. The different pipe layers as shown, for example, in FIG. 1 are terminated in an end fitting in such a way as to transfer the load between the flexible pipe and the connector.

Figure 2:
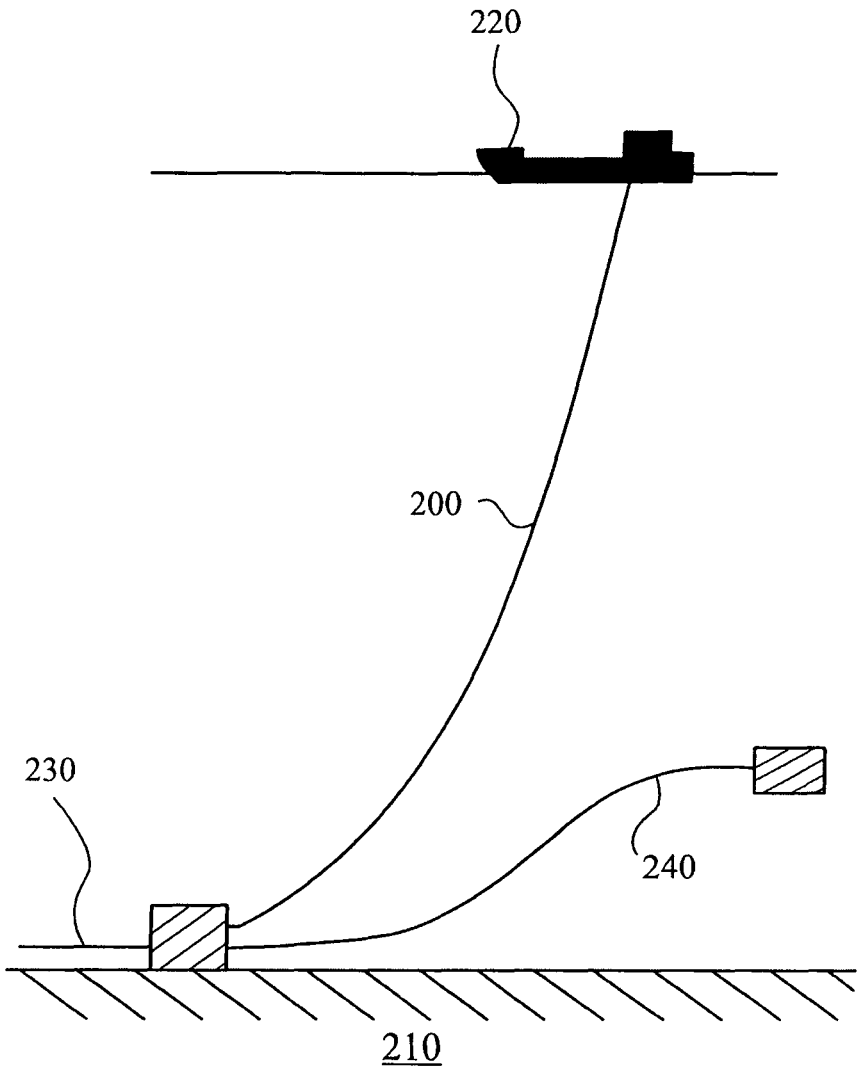
FIG. 2 illustrates a riser, flowline and jumper.

FIG. 2 illustrates a riser assembly 200 suitable for transporting production fluid such as oil and/or gas and/or water from a sub-sea location 210 to a floating facility 220. For example, in FIG. 2 the sub-sea location 210 is a connection to a sub-sea flow line 230. The flexible flow line comprises a flexible pipe, wholly or in part, resting on the sea floor or buried below the sea floor. The floating facility may be provided by a platform and/or buoy or, as illustrated in FIG. 2, a ship. The riser 200 is provided as a flexible riser, that is to say a flexible pipe connecting the ship to the sea floor installation. Alternatively the flexible pipe can be used as a jumper 240.

Figure 3:
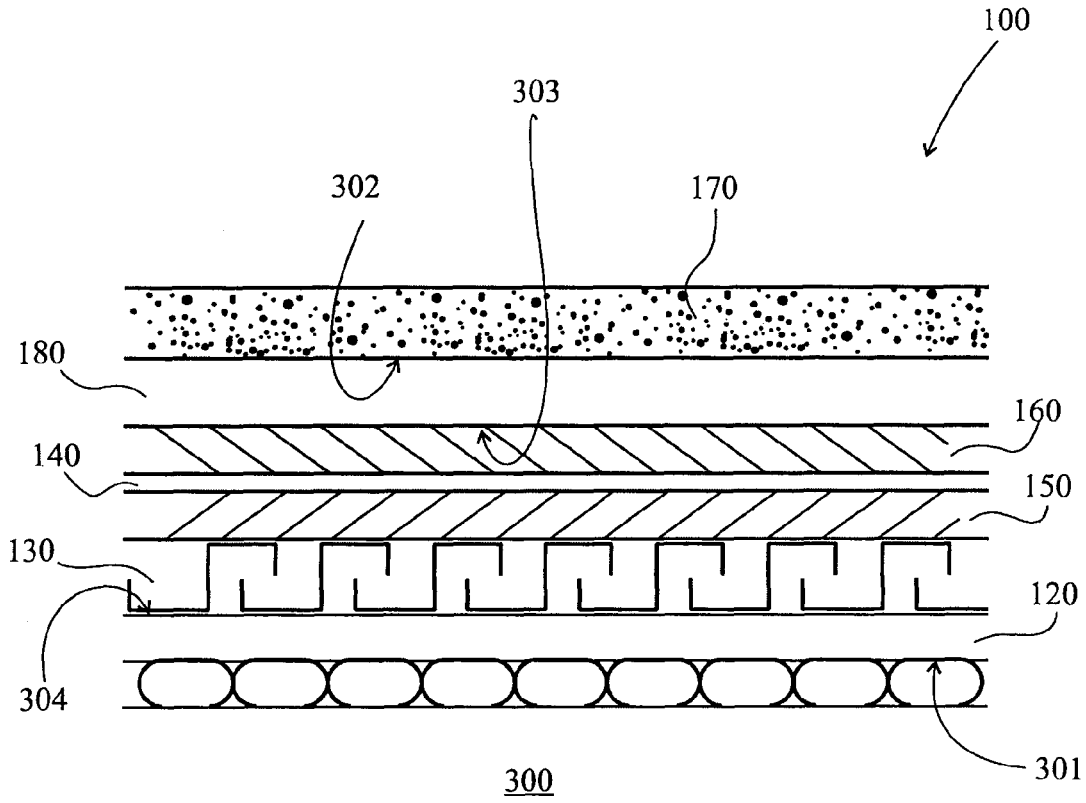
FIG. 3 illustrates use of boron holding grease on a pressure armour layer.

FIG. 3 illustrates a cross section through a portion of flexible pipe body 100. An inner bore 300 provides a central fluid path along which fluid flows in use. The internal bore is defined between the inner surface 301 or the barrier layer 120. The inner carcass 110 supports the barrier layer but is not fluid tight. A pressure armour layer 130 overlies the barrier layer and is formed by interlocked windings as is well known in the art. The pressure armour layer 130 prevents burst through of the barrier layer 120 when internal pressures of the transport fluid exceed external pressures. Counter wound tensile armour layers 150, 160 are laid over the pressure armour layer and are separated by one or more tape layers 140. An insulating layer 180 which may be formed by multiple layers is formed radially outwardly from the outer tensile armour layer 160 and the flexible pipe body is protected by an outer sheath 170. It will be appreciated that embodiments of the present invention are not restricted to the use of such layers.

On occasion flexible pipes are utilised to transport production fluids which include acidic components. As such the inner bore and carcass are on occasion continually subjected to acidic conditions. A notable acidic component is hydrogen sulphide (H2S). Generally speaking the barrier layer 120 is composed of a material which prevents radially outward movement of the transported fluid. However, over time the material of the barrier layer is such that H2S can permeate radially outwardly through the barrier layer and into the annular space formed between an inner surface 302 of the outer sheath 170 or an inner surface 303 of an innermost insulating layer. This annular region defined between the outer surface 304 of the barrier layer 120 and the inner surface of an outer fluid impermeable layer extends longitudinally along the whole length of the flexible pipe body between end fittings (not shown). As the H2S gas accumulates over time the annular environment becomes more and more acidic.

Prior to use, in order to combat this expected acidic environment the windings of the pressure armour layer 130 and the tensile armour layers 150, 160 are coated with a layer of boron holding grease. It is sufficient during manufacture to introduce the grease at predetermined locations in the knowledge that during use as the flexible pipe flexes the boron holding grease will migrate to evenly coat all surfaces of the metallic components in the annulus.

Figure 4:
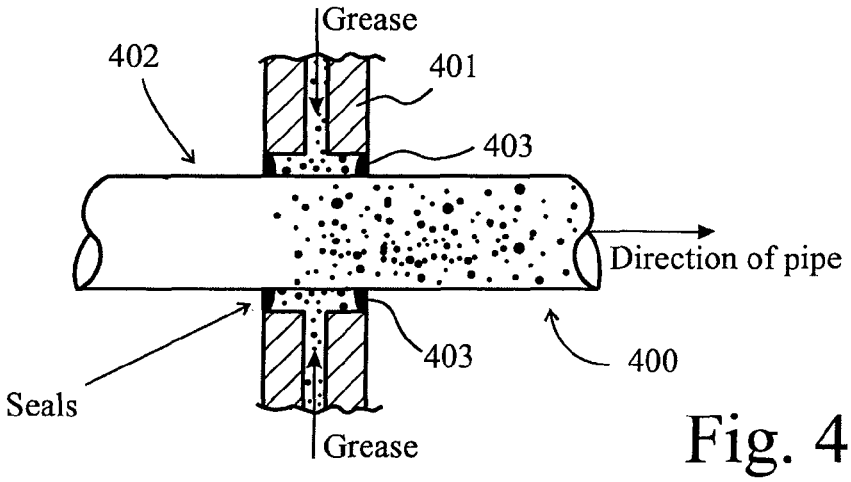
FIG. 4 illustrates application of grease to a layer of the flexible pipe body.

FIG. 4 illustrates how a boron holding grease 400 may be introduced over a layer of the flexible pipe body during a manufacturing process. The part constructed flexible pipe body 400 is introduced to a grease application station 401 which includes a rigid body having a central aperture 402. The inner diameter of the aperture 402 is greater than an outer diameter of the flexible pipe body during that stage of construction. Sealing rings 403 are located at an upstream and downstream end of the orifice 402 and grease is pumped from a remote reservoir through a connecting passageway into the annular space between an outer surface of the part constructed pipe and the inner surface of your office 402. As the pipe extends during manufacturing grease is continually smeared over the outer surface of the pipe. It will be understood that one or more of these grease pumping stations may be provided at various times during construction of the flexible pipe body with the internal diameter of the station and diameter of the seals being specifically selected for that stage of manufacture and dependent upon the outer diameter of the flexible pipe body at that stage. Grease may be applied to a non-metallic surface prior to winding a metal wire around that layer or alternatively or in addition may be applied to an outer surface of a metal layer.

Figure 5:
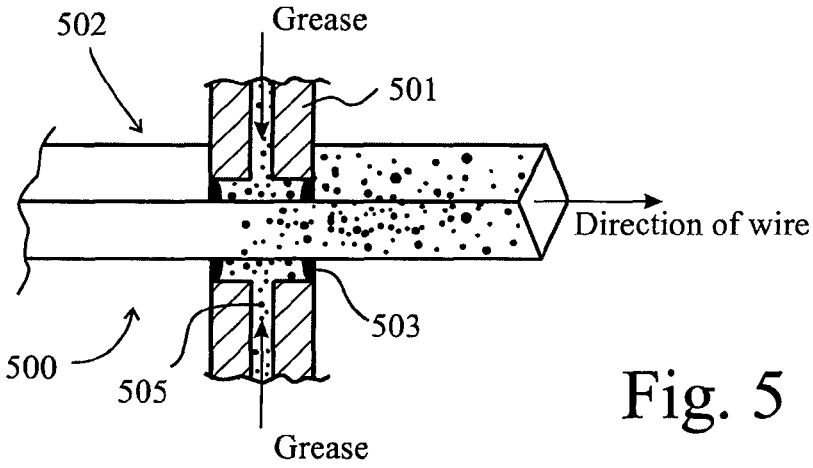
FIG. 5 illustrates application of grease to a wire.

FIG. 5 illustrates an alternative station 500 utilised during manufacture of the flexible pipe body. Rather than applying grease to the part built flexible pipe as illustrated in FIG. 4, FIG. 5 illustrates that grease may be applied to an outer surface of metallic wires which are subsequently wrapped around the flexible pipe body. As illustrated in FIG. 5 a pumping station body 501 has a central orifice 502 which is sized and shaped according to the cross sectional dimensions of the wire which is to be wrapped. Seals 403 seal the orifice 502 against the outer surface of the wire. Grease is pumped via one or more passageways 505 which extend through the station body 501 from a grease store. As the wires are drawn through the station in a direction of wire movement an outer surface of the wire is coated in grease.

Figure 6:
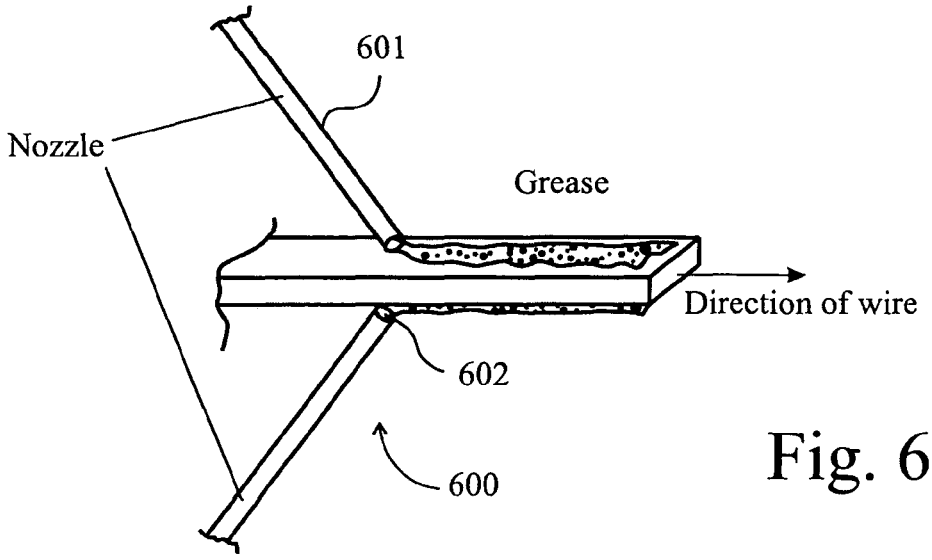
FIG. 6 illustrates application of grease to a wire.

FIG. 6 illustrates a still further embodiment of the present invention in which grease is applied to an upper and lower surface of a wire used for manufacturing flexible pipe body. Nozzles at a grease applying station 600 are rigidly secured in place with respect to a location of the wires as they move in a direction of wire movement. Each nozzle 601 has an exit orifice 602 from which grease is pumped continually or repeatedly. This coats selected sections of the wire which, when wrapped around an underlying layer of the flexible pipe body coats the metallic components.

It will be appreciated that if a boron containing fluid or oil is utilised, rather than the grease as above described, then the application stations will be modified accordingly.

The boron based grease introduces boric acid and/or Hydrogen Orthoborate which produces a chemical reaction when in the presence of air and moisture vapour. This has the effect of modifying the surface of the metallic components of the flexible pipe body (and any treated metallic components of end fittings). The surface produced has both an improved friction and wear property as well as an improved resistance to acid. This improved resistance to acid allows flexible pipe body to be utilised in locations where sour service operation is to be expected. The boron based grease or other boron carrying fluid or oil can be applied to the metallic layers of flexible pipes or other metal components which are required to have resistance to acid corrosion or require improved sour service capability. After a period of exposure a chemical reaction occurs which modifies the surface of the material to produce a coating with similar properties to the properties attained during a hot boronizing process.

Boronizing is a thermo-chemical surface treatment in which boron atoms are diffused into the surface of a work piece to form borides with the base material. When applied to appropriate materials boronizing provides wear and abrasion resistance. It has now been understood that in addition to this improved friction and wear property and in the absence of requiring an actual hot boronizing process the introduction of boron holding grease or boron holding fluid or oil onto the metallic components of flexible pipe body produces an improvement in acid resistance. The coating is self healing when in the presence of boron and air/moisture so that any surface damage will also be quickly modified to produce a surface coating with increased acid resistance. As an alternative the metallic components of flexible pipe can be treated with a hot boronizing process.

Although boron based products have in the past been used as lubricants to surfaces where wear is expected the improved corrosion resistance benefits have not, until now, been appreciated. Pre-application of boron holding grease or other fluid or oil with time allowed for the chemical reaction leads to significant advantages with respect to prior known flexible pipe operation. It will be appreciated that grease and oil and fluid could be utilised in any combination if desired.

Embodiments of the present invention enable the use of less exotic material in sour service conditions.

Treatment of tensile and pressure vault layers of flexible pipes can thus be carried out to improve sour service performance on metallic, such as steel, materials. Treatment of stainless steel carcass in flexible pipes to improve the corrosion resistance of the carcass layer is also achievable. Treatment of other metallic components in the flexible pipe body or in end fittings secured to ends of the flexible pipe body increases the corrosion resistance and resistance to acid of the materials.

The boron holding grease can be applied to a wide range of metal components including components made from alloys including carbon steel, tool steel and/or and stainless steel. In addition, materials such as nickel-based alloys, cobalt-based alloys and molybdenum can be treated. Nickel alloy can be boronized without sacrificing corrosion resistance as well as producing extreme surface wear resistance.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. Use of a boron holding grease or fluid or oil for the purpose of increasing acid resistance and/or corrosion resistance in at least one metallic component of a flexible pipe body for transporting production fluids from a sub-sea location, comprising applying a boron holding grease or fluid or oil to a portion of the metallic component of the flexible pipe body, and in the absence of requiring an actual hot boronizing process, exposing the boron holding grease or fluid or oil and the metallic component to air and moisture for at least a predetermined period of time, such that a chemical reaction occurs which modifies the surface of the metallic component.

2. The use as claimed in claim 1 wherein the metallic component comprises one or more of a carcass and/or pressure armour layer and/or tensile armour layer and/or inner or outer sleeve of the flexible pipe body.

3. The use as claimed in claim 1, further comprising:

modifying a surface of the metallic component via a chemical reaction, a natural acid resistance and/or corrosion resistance associated with the material of the metallic component being increased during the modifying process.

4. The use as claimed in claim 3, wherein the surface of the metallic component is modified to produce a self-healing surface coating, such that any surface damage is modified to produce a surface coating with increased resistance to acid.

5. The use as claimed in claim 4, wherein the modification in response to the damage occurs in the presence of boron and air or moisture.

6. A method for treating a pressure armour and/or tensile armour layer of a flexible pipe body for transporting production fluids from a sub-sea location, comprising the steps of:

applying a boron holding grease or fluid or oil to at least a portion of the pressure armour layer and/or tensile armour layer of a flexible pipe body, and in the absence of requiring an actual hot boronizing process, exposing the boron holding grease or fluid or oil and the pressure armour and/or tensile armour layer to air and moisture for at least a predetermined period of time, such that a chemical reaction occurs which modifies the surface of the pressure armour and/or tensile armour layer, thereby improving acid resistance of the layer.

7. The method as claimed in claim 6 wherein the treatment improves sour service performance of the metallic layer.

8. A method for treating a carcass layer of a flexible pipe body, comprising the steps of:

applying a boron holding grease to at least a portion of the carcass layer to, and in the absence of requiring an actual hot boronizing process, exposing the boron holding grease or fluid or oil and the carcass to air and moisture for at least a predetermined period of time, such that a chemical reaction occurs which modifies the surface of the carcass layer, thereby improving corrosion resistance of the carcass layer.

9. A method for treating at least one metallic component of a flexible pipe body, comprising the steps of:

applying a boron holding grease or fluid or oil to at least a portion of the metallic component during manufacture of the flexible pipe body, and in the absence of requiring an actual hot boronizing process, exposing the boron holding grease or fluid or oil and the metallic component to air and moisture for at least a predetermined period of time, such that a chemical reaction occurs which modifies the surface of the metallic component, thereby improving acid resistance and/or corrosion resistance of the metallic component when in service.

10. The method of treatment as claimed in claim 9 wherein the metal of the metallic component comprises one from the possible options of steel alloy, carbon steel, low alloy steel, tool steel, stainless steel, nickel based alloy, cobalt based alloy, carbide and/or molybdenum.

11. The method of treatment as claimed in claim 9, wherein the metallic component comprises an internal layer of the flexible pipe body.

12. The method of treatment as claimed in claim 11, wherein the internal layer comprises a carcass layer, a pressure armour layer or a tensile armour layer of the flexible pipe body.

* * * * *